US006000135A

United States Patent [19]

Ullmann et al.

[11] Patent Number: 6,000,135

[45] Date of Patent: Dec. 14, 1999

[54] DRY SHAVING APPARATUS WITH GUARD MEMBER

[75] Inventors: Roland Ullmann, Offenbach; Bernd Tewes, Wiesbaden-Medenbach; Bernhard Best, Oberursel, all of Germany

[73] Assignee: Braun Aktiengesellschaft, Germany

[21] Appl. No.: 08/888,428

[22] Filed: Jul. 7, 1997

[30] Foreign Application Priority Data

Aug. 16, 1996 [DE] Germany ..... 196 33 037

[51] Int. Cl.[6] ..... B26B 19/38

[52] U.S. Cl. ..... 30/43.92; 30/34.05; 30/537

[58] Field of Search ..... 30/34.05, 43.9, 30/43.91, 43.92, 537; D28/49, 51

[56] References Cited

U.S. PATENT DOCUMENTS

| | | | |
|---|---|---|---|
| 2,691,216 | 10/1954 | Ross | 30/537 |
| 2,787,830 | 4/1957 | Argiro | 30/34.05 |
| 2,803,874 | 8/1957 | Obolensky . | |
| 4,751,781 | 6/1988 | Szymansky et al. | 30/43.92 |
| 4,969,266 | 11/1990 | Poganitsch | 30/43.92 |
| 5,193,275 | 3/1993 | Hirokazu et al. | 30/43.92 |

FOREIGN PATENT DOCUMENTS 2-017558 5/1990 Japan .

*Primary Examiner*—Hwei-Siu Payer
*Attorney, Agent, or Firm*—Fish & Richardson P.C.

[57] ABSTRACT

The invention is directed to a dry shaving apparatus comprising a casing (7) formed by face walls (1, 2) and narrow sidewalls (3, 4, 5, 6), an electric driving mechanism for at least one cutter assembly (S), at least one control switch (20), and a guard member pivotally mounted on the casing (7) and having a cap portion (18) of an essentially U-shaped configuration for protecting the shaver assembly, wherein the cap portion (18) with at least one guard wall (16, 17) extending parallel to the face walls (1, 2) is pivotally mounted on at least one of the face walls (1, 2) of the casing (7) by means of a rotary joint, and the control switch (20) is actuatable only when the cap portion (18) and the guard wall (16, 17) are in a pivot position in which the shaver assembly (S) is released.

31 Claims, 5 Drawing Sheets

DRY SHAVING APPARATUS WITH GUARD MEMBER

FIELD OF INVENTION

This invention relates to a dry shaving apparatus comprising a casing formed by face walls and narrow sidewalls, an electric driving mechanism for at least one cutter assembly, at least one control switch, and a guard member pivotally mounted on the casing and having a cap portion of an essentially U-shaped configuration for protecting the shaver assembly.

BACKGROUND OF THE INVENTION

A dry shaving apparatus of the type initially referred to is known from Japanese Utility Model JP-2-17558 (Y2). Integrally formed on the two ends of the cap portion are narrow support arms hinged to the two narrow sides of the casing of the dry shaving apparatus both slidably and rotatably by means of a respective sliding-and-rotary joint. For this purpose, a hinge pin is resiliently carried in each of the two end walls of the casing and engages an elongated groove provided in the end walls of the support arms. The distance the guard member is allowed to slide is predetermined by the length of the grooves, that is, by abutment of the hinge pins with the end walls of the grooves. For the purpose of releasing a shaver assembly protected by the guard member, the guard member with the support arms integrally formed thereon are pushed over the shaver assembly until a pivotal motion of the support arms about the hinge pins can be effected. Following execution of such a pivotal motion through an angle of 180°, the guard member is located beneath the bottom wall of the dry shaver casing extending parallel to the shaver assembly, in which position it can be pushed onto the casing and locked in place. For lack of adequate space, the arrangement of the sliding-and-rotary joint in the narrow sides of the casing and the narrow support arms of the cap portion makes it necessary for the components of the sliding-and-rotary joint to be built to relatively small dimensions, with the result that the risk of breakage increases in the course of use of the dry shaving apparatus. The manipulation of a guard device mounted both slidably and rotatably on the narrow sides of a casing is difficult, resulting frequently in jamming of the engaging components of the sliding-and-rotary joint.

From U.S. Pat. No. 2,787, 830 it is known to mount a dry shaving apparatus in a disk-type casing so as to be pivotal within limits—through an angle of 90°, approximately—by means of hinge pins engaging in bearing shells. A segment-type interruption provided in the circular profile of the round casing serves to enable a rotary movement of the dry shaving apparatus protruding from the interruption until the shaving head is exposed for use, in addition to enabling the cord plug of a power cord to be connected with the dry shaving apparatus through the disk-type casing in order to start operation of the electric drive mechanism directly.

SUMMARY OF THE INVENTION

It is an object of the present invention to improve a dry shaving apparatus of the type initially referred to.

An essential advantage of the present invention resides in that both for protecting the shaver assembly and for releasing the shaver assembly by the guard member only a movement of the pivotally mounted guard member in one of the pivot directions—in clockwise or counterclockwise direction—need be executed. In addition, the guard member mounted on the face walls of the casing has substantially more space available for the dimensioning and the construction of the rotary joint(s), ensuring a rugged mounting of the cap portion of the guard member by means of one or both guard walls on the respective face wall of the casing.

In a preferred embodiment of the present invention, the rotary joint is formed by cooperating positive-engagement elements provided on the face wall and on the guard wall. Preferably, the positive-engagement elements are configured as a round recess and a round pin engaging the recess. Providing the rotary joint on the face wall and on the guard wall enables the positive-engagement elements to be relatively amply dimensioned, as a result of which the sliding motion of a round recess on a round pin engaging the recess proceeds relatively smoothly. In a preferred embodiment of the present invention, the round pin is provided on a face wall of the casing. For adaptation to this embodiment, the round recess is provided in the guard wall. Integrating the cooperating positive-engagement elements to form a rotary joint into the existing components such as the face wall of the casing and the guard wall carrying the cap portion presents an embodiment of the invention which affords particular economy of manufacture.

According to an alternative embodiment of the present invention, the round pin is provided on the guard wall. For registry with the corresponding round pin, the round recess is provided in a face wall of the casing. In a particularly advantageous embodiment of the present invention, the round recess is configured as an opening extending completely through the guard wall. In another advantageous embodiment, the round recess is configured as an opening extending completely through the face wall of the casing.

A very straightforward and low-cost coupling of the positive-engagement elements is accomplished by the invention in that the positive-engagement elements of the face wall and of the guard wall are held in cooperable fashion by means of a snap fitting. In a further aspect of this embodiment, the snap fitting is formed by a circumferential groove and a spring of a resilient spring arm adapted to snap into this groove. Preferably, the groove is provided on a round pin, and the spring arm with the spring is resiliently formed with the wall of the round recess by means of a film hinge.

For maintaining friction low between the cooperating positive-engagement elements, slide ribs are provided between the round pin and the round opening. In a preferred embodiment of the present invention, the slide ribs are integrally formed on the inner wall of the round opening. In an alternative embodiment of the present invention, the slide ribs are integrally formed on the outer wall of the round pin.

In a further embodiment of the present invention, the positive-engagement elements of the face wall and the guard wall are held in cooperable fashion by means of a plug-and-socket connection.

According to an embodiment of the present invention that affords great ease of handling by a user, the guard member is formed by two guard walls and a cap portion connecting the guard walls. An embodiment of the present invention affording economy of manufacture is characterized in that the guard member is formed by one guard wall and a cap portion provided on the guard wall.

To facilitate manipulation of the dry shaving apparatus in use, an embodiment of the present invention makes provision for resiliently mounted detent means for holding the guard member in at least one pivot position. In an embodiment of the present invention, the control switch is arranged in the guard wall. In a further aspect of this embodiment of the present invention, the control switch with the guard wall is pivotally mounted by means of the rotary joint.

In a further preferred embodiment of the present invention, the control switch is provided in a positive-engagement element extending completely through the guard wall. Preferably, the control switch is configured as a slide control. An embodiment of the present invention makes provision for a recess in a guard wall for at least one control movement of the slide control. Preferably, the recess is provided in a pivotally mounted guard wall. A location of the recess in the guard wall in a position such that, with a cap portion in opposition to the shaver assembly, the recess is utilized in that a displacement of the control switch into the recess causes activation of the electric drive mechanism of the dry shaving apparatus, has automatically the result that on a pivotal movement of the guard wall through an angle of 180°—upon execution of which the cap portion of the guard member embraces the shaver assembly in the shape of a U—the control switch which is in the OFF position is inhibited from being moved into the ON position provided in the guard wall, without additional components being needed to this effect.

In a further embodiment of the present invention, the recess is provided in a face wall of the casing. In a further aspect of this embodiment of the invention, the recess is formed in a circular-ring-shaped annular wall of a positive-engagement element. In still another aspect of this embodiment, a pin movable into the recess is provided on the control switch.

According to an embodiment of the present invention, the relative distances R1 of the axis of rotation D to the two narrow sidewalls are identical. In a further embodiment of the present invention, the relative distance R1 of the axis of rotation D to the outermost point P of the shaver assembly S is greater than the distance R3 to the outermost point P1 of the casing section opposite the shaver assembly S. In another suitable embodiment of the present invention, the relative distance R1 of the axis of rotation D to the outermost point P of the shaver assembly S is equal to the distance R1 to the outermost point P1 of the casing section opposite the shaver assembly S.

Some preferred embodiments of the present invention will be described in the following with reference to the accompanying drawings.

DETAILED DESCRIPTION OF THE PREFERRED EMBODIMENT

Figure 3:
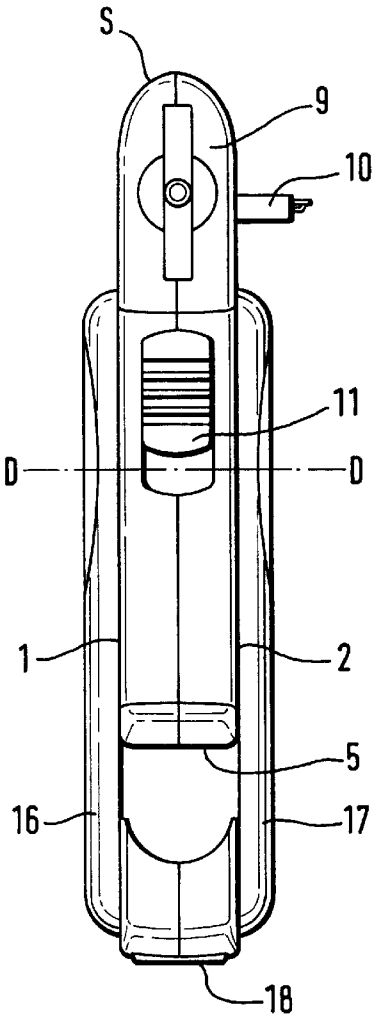
FIG. 3 is a view of one of the narrow sidewalls of the dry shaving apparatus of FIGS. 1 and 2, showing a cap portion provided on two guard walls and in a position opposite the shaver assembly, and a long-hair trimmer assembly in the trimming position.
Figure 1:
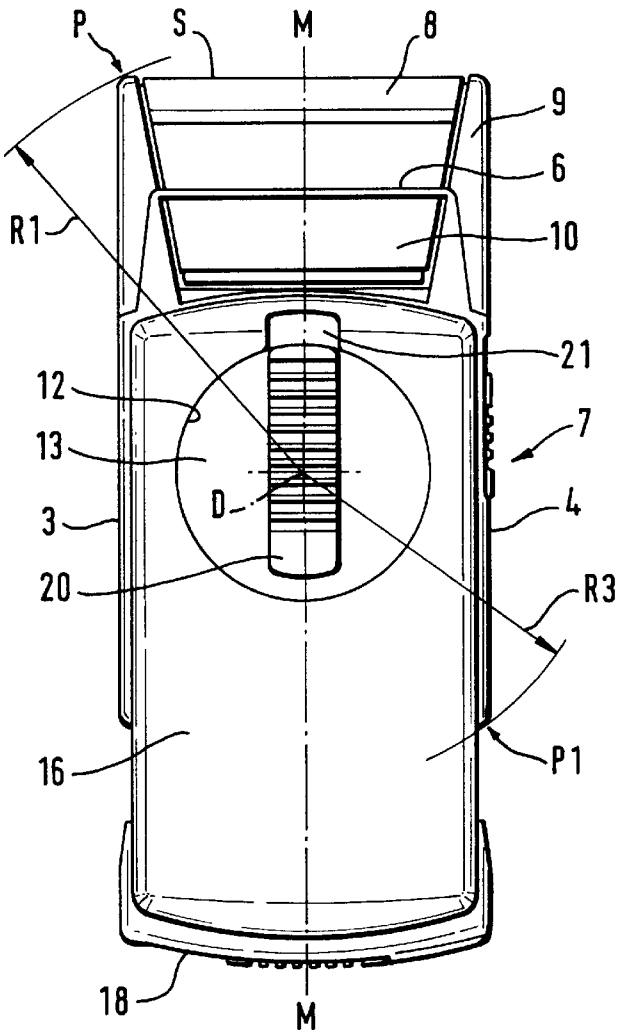
FIG. 1 is a front view of a dry shaving apparatus, showing a cap portion pivoted about a positive-engagement element through an angle of 180°.

FIG. 1 shows the front view of a dry shaving apparatus with a casing 7 substantially comprised of two face walls 1 and 2 and four narrow sidewalls 3, 4, 5, 6, with a cutter assembly S configured as a short-hair cutter assembly being arranged on the narrow sidewall 6. The short-hair cutter assembly is comprised of an outer cutter 8 held with tension in a shaving head frame 9 in arched shape, as well as of an inner cutter, not shown, which is operatively associated with the outer cutter 8. The shaving head frame 9 is detachably coupled to the casing 7. Beneath the shaving head frame 9, there is provided in the casing 7 a long-hair trimmer assembly 10 which extends parallel to the cutter assembly S and is adapted to be swung out of the face wall 2. By means of a switch 11 disposed in the narrow sidewall 4, the long-hair trimmer assembly 10 is pivotal into the trimming position shown in FIG. 3 and, following another actuation of the switch 11, is pivotal in the opposite direction into the interior of the casing 7, occupying therein a protected position of rest.

A positive-engagement element 13 is integrally formed on the face wall 1 of the casing 7. A guard wall 16 is rotatably mounted on the positive-engagement element 13, which is configured as a round pin, by means of a positive-engagement element 12 which is configured as a round opening extending completely through the guard wall 16. A cap portion 18 is integrally formed on the guard wall 16—see FIG. 3. The cap portion 18 is pivotally mounted on the face wall 2 of the casing 7 by means of a further guard wall 17 and further positive-engagement elements 14 and 15—see sectional view of FIG. 4.

FIG. 1 shows the dry shaving apparatus in condition ready for use. Accordingly, the cap portion 18 is in a pivot position opposite the cutter assembly S, that is, in a position extending parallel to the narrow sidewall 5 forming the bottom wall of the casing 7.

Figure 2:
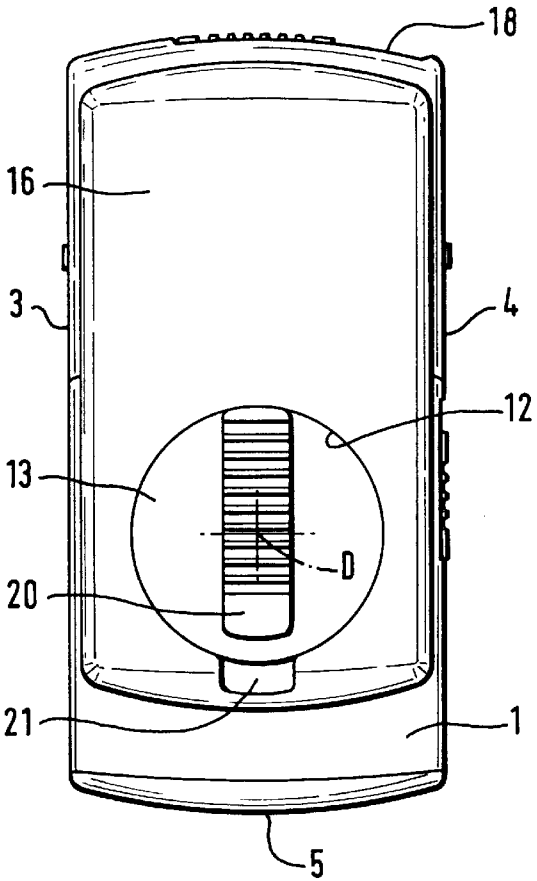
FIG. 2 is a front view of a dry shaving apparatus, showing a cap portion protecting the shaver assembly as well as a guard wall mounted for rotation about a positive-engagement element.

Arranged in the pin forming the positive-engagement element 13 is a control switch 20 for activation of the electric driving mechanism, the switch extending through the outer wall of the positive-engagement element 13 which is part of the face wall 1 of the casing 7. The control switch 20 is configured as a slide switch. The contact path 21 of the control switch 20 is formed in the guard wall 16 carried on the round positive-engagement element 13 such that the control switch 20 is allowed to slidably enter the contact path 21 only when the cutter assembly S is released by the cap portion 18, such control motion serving to activate the electric driving mechanism of the dry shaving apparatus. With the dry shaving apparatus switched off, the control switch 20 is within the contour of the round positive-engagement element 13, enabling the guard wall 16 with the integrally formed cap portion 18 to perform a pivotal motion about an angle of 180° into a pivot position in which the cap portion 18 is above the cutter assembly S, as illustrated in FIG. 2. With the cap portion 18 in such a pivot position which protects the cutter assembly S, the wall of the round opening of the positive-engagement element 12 inhibits any control movement of the control switch 20. Such a relative coordination of the shaping of the positive-engagement elements 12, 13 and the control switch 20 and their cooperative relationship ensure a reliable protection of the dry shaving apparatus against accidental activation using a cap portion 18 swung over the cutter assembly S for protection of the cutter assembly S, without involving the need for additional components to inhibit activation of the control switch 20.

FIGS. 4, 5, 6 and 7 illustrate a variety of embodiments of the coupling of a cap portion 18 protecting the respective cutter assembly S to one or two guard walls 16, 17 as well as to one or two face walls 1 and 2 of the casing 7 of a dry shaving apparatus.

Figure 4:
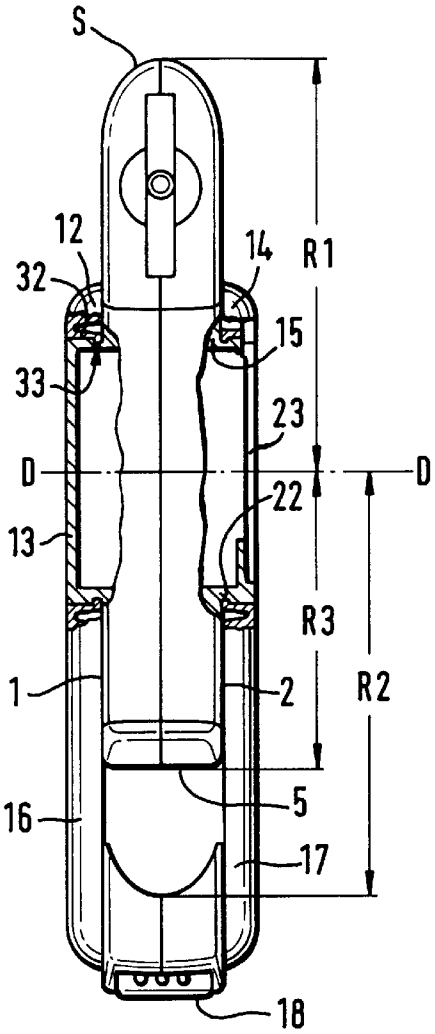
FIG. 4 is a side view of the dry shaving apparatus of FIGS. 1 to 3, showing cooperating positive-engagement elements provided on the face walls of the casing as well as on the guard walls.

In the embodiment of FIG. 4, a positive-engagement element 13, 15 configured as a round pin and having a circumferential groove 22 each is integrally formed on both face walls 1 and 2 of the casing 7. The closed outer wall of the positive-engagement element 13 is, for example, flush with the outer surface of the guard wall 16. By contrast, there is formed in the outer wall of the positive-engagement element 15 an aperture 23 to receive and guide the control switch 20. Provided in the guard walls 16 and 17 are the positive-engagement elements 12 and 14 in the form of round openings extending completely through the guard walls 16 and 17. Spring arms 32 with a spring 33 engaging within the groove 22 are resiliently formed on the periphery of the opening of the positive-engagement elements 12 and 14, resulting in a snap fitting between the positive-engagement elements 12, 13, 14 and 15. By means of this snap fitting, the guard walls 16, 17 are rotatably coupled to the positive-engagement elements 13, 15 and held.

Figure 5:
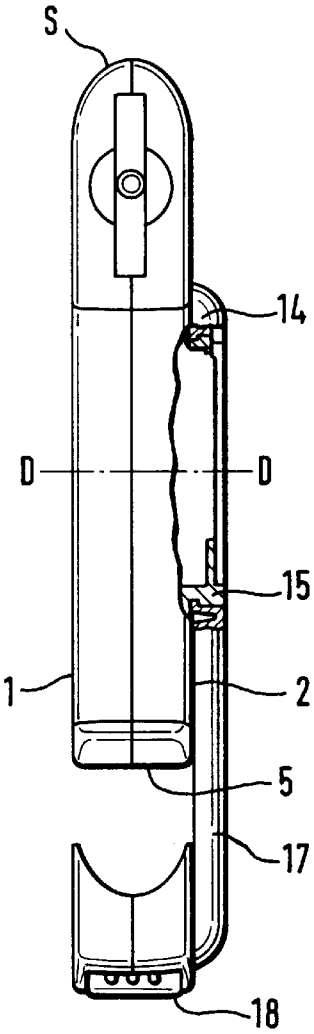
FIG. 5 is a side view of the dry shaving apparatus of FIGS. 1 to 3, showing positive-engagement elements provided on a face wall of the casing and on a guard wall.

FIG. 5 shows an embodiment of a dry shaving apparatus with only one positive-engagement element 15 formed on a face wall 2 of the casing 7 and a guard wall 17 carrying the cap portion 18 and being rotatably coupled to the positive-engagement element 15 by means of a positive-engagement element 14.

Figure 6:
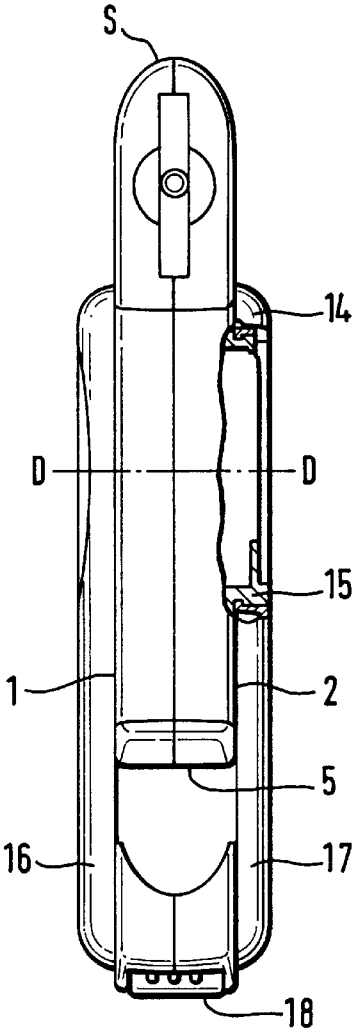
FIG. 6 is a side view of the dry shaving apparatus of FIGS. 1 to 3, showing two guard walls carrying a cap portion, as well as positive-engagement elements provided on one face wall and one guard wall, respectively.

The embodiment of FIG. 6 differs from the embodiment of FIG. 5 by the arrangement of an additional guard wall 16 formed on the cap portion 18 and extending parallel to the face wall 1 of the casing 7. The embodiment of FIG. 6 does not make provision for coupling, by positive engagement, of the face wall 1 with the guard wall 16.

Figure 7:
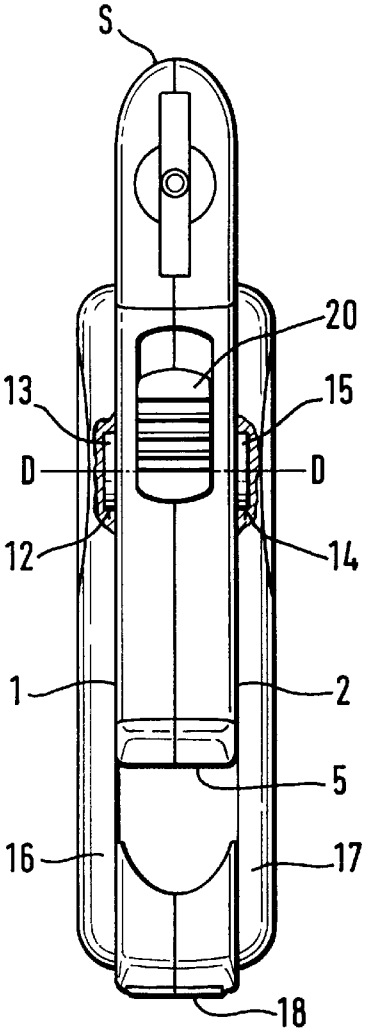
FIG. 7 is a side view of the dry shaving apparatus of FIGS. 1 to 3, showing positive-engagement elements configured as a rotary joint provided on the two face walls of the casing and on the guard walls extending parallel thereto.

In the embodiment of FIG. 7, the registering positive-engagement elements 12, 13, 14, 15 of the face walls 1, 2 and the guard walls 16, 17 carrying the cap portion 18 are of smaller diameter by comparison with the embodiments receiving a control switch 20 as in FIGS. 4 to 6, for example, and yet they are larger and accordingly of a more rugged construction than in the known dry shaving apparatus of JP-Y2-2-17558. The control switch 20 for setting the dry shaving apparatus in operation is arranged in one of the narrow sidewalls 4 of the casing 7.

Figure 12:
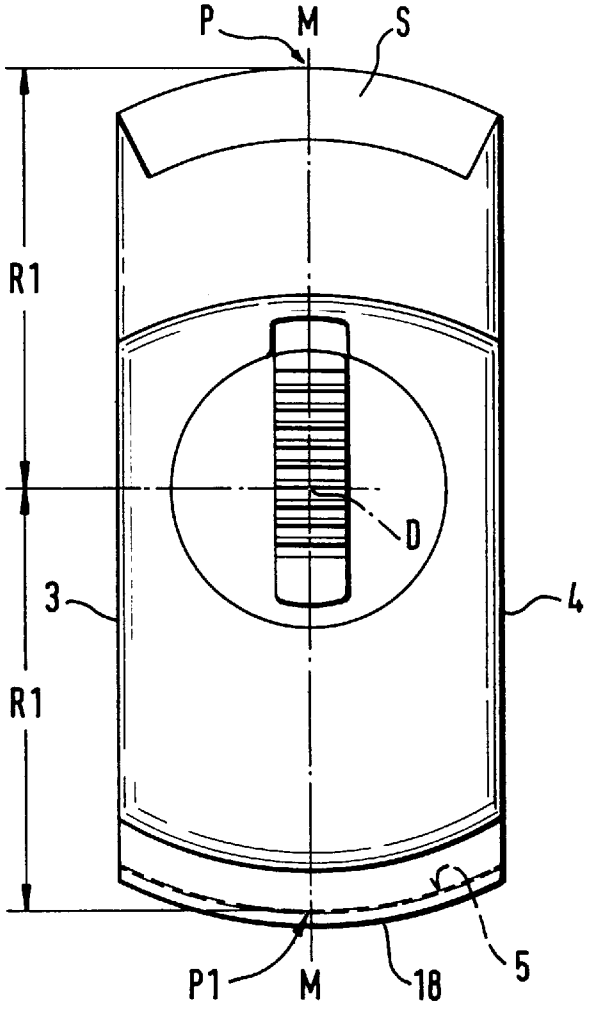
FIG. 12 is a front view of a dry shaving apparatus, showing a shaver assembly extending in arched form over the wide dimension of the casing, as well as a bottom wall and a control switch disposed in the rotary joint for the guard wall.

In FIGS. 1 and 4 to 7 as well as 12 and 13, the axis of rotation for the pivotally mounted guard member is designated as D. The dry shaving apparatus of FIG. 12 includes an elongated shaver assembly S extending in an arcuate configuration substantially from a narrow sidewall 3 to an opposite narrow sidewall 4 on either side of the vertical center line M. In this embodiment, the relative distance R1 of the outermost point P of the arcuate shaver assembly S to the axis of rotation D equals the relative distance R1 of the axis of rotation D to the outermost point Pl of the equally arcuate narrow sidewall 5 representing the bottom wall of the casing 7. The inner wall of the pivotally mounted cap portion 18 is spaced from the axis of rotation D by a distance R2 slightly greater than the distance R1 in order to ensure a pivotal motion of the cap portion 18 over the shaver assembly S about the axis of rotation D to protect the shaver assembly S, as well as a pivotal motion over the narrow sidewall 5 of the casing 7 to release the shaver assembly S.

In an alternative embodiment as explained in more detail with reference to FIG. 4, for example, and as appears directly from the side views of the dry shaving apparatus of FIGS. 3, 5, 6 and 7, the relative distance R3 of the narrow sidewall 5 to the axis of rotation D is smaller than the relative distance R1 of the axis of rotation to the outermost point P of the shaver assembly S. In a linear shaver assembly S—see FIG. 1—the points of reference for measuring the distance R1 are the axis of rotation D at the one end and the outermost point P of the shaver assembly S arranged on the casing 7 of the dry shaving apparatus and extending linearly substantially from a narrow sidewall 3 to an opposite sidewall 4 at the other end. The distance R2 between the axis of rotation and the outermost point of the U-shaped inner wall of the cap portion 18 is, in turn, slightly greater than the distance R1 in order to ensure a pivotal motion of the cap portion 18 over the shaver assembly S. The relative distance R3 of the axis of rotation to the narrow sidewall 5 of the casing 7 may be varied freely within the limits of the distance R2. Any variation, that is, a reduction of the distance R3, results in a reduced size of the dry shaving apparatus, with the consequence that, with a cap portion 18 held in place over the shaver assembly S, that is, with the dry shaving apparatus in a condition in which it cannot be used, the size of the dry shaving apparatus is very small and convenient, whereas with a dry shaving apparatus in condition of use in which the cap portion 18 is parallel to the narrow sidewall 5 of the casing 7, the dry shaving apparatus is extended in length, that is, of increased size, by reason of the guard walls 16, 17 and the cap portion 18, whereby the manipulation of such a reduced-size dry shaving apparatus is facilitated materially during the shaving operation.

Figure 8:
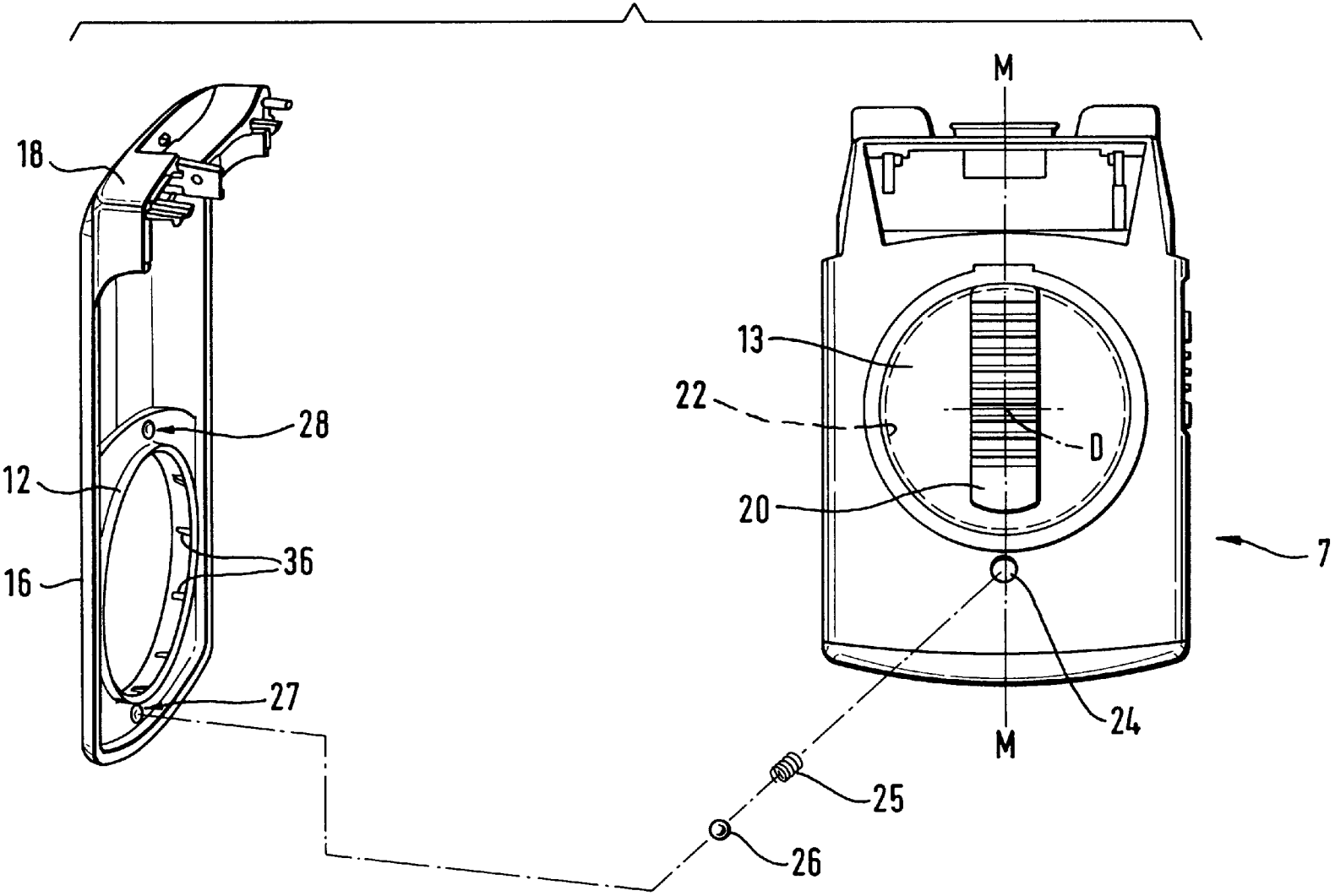
FIG. 8 is an exploded view of a casing shell with a positive-engagement element and a control switch, as well as a guard wall with an opening extending completely through the guard wall to serve as a positive-engagement element.

FIG. 8 shows the face wall 1 of the casing 7 with a cooperating guard wall 16 detached therefrom. Provided on the face wall 1 is the positive-engagement element 13 with the groove 14 —represented by a broken line—to receive the spring 33 arranged on a spring arm 32 and constituting part of the positive-engagement element 12 of the guard wall 16. The control switch 20 is arranged in the positive-engagement element 13. Integrally formed in the face wall 1 is a recess 24 for accommodating a spring element 25 and a ball 26. These are detent means which, in operative association with a first detent recess 28 and a second detent recess 27 on the inside of the guard wall 16, serve the function of positioning the guard wall 16 carrying the cap portion 18 in a location exposing the shaver assembly S and a location protecting the shaver assembly S. In consequence, the detent recesses 27 and 28 are disposed on the arc of a circle about the axis of rotation D in a 180° offset relationship to each other. Several slide ribs 36 are formed on the inner wall of the positive-engagement element 12 configured as a round opening, these ribs operating to reduce friction significantly when the guard wall 16 is rotated on the positive-engagement element 13 configured as a round pin.

Figure 11:
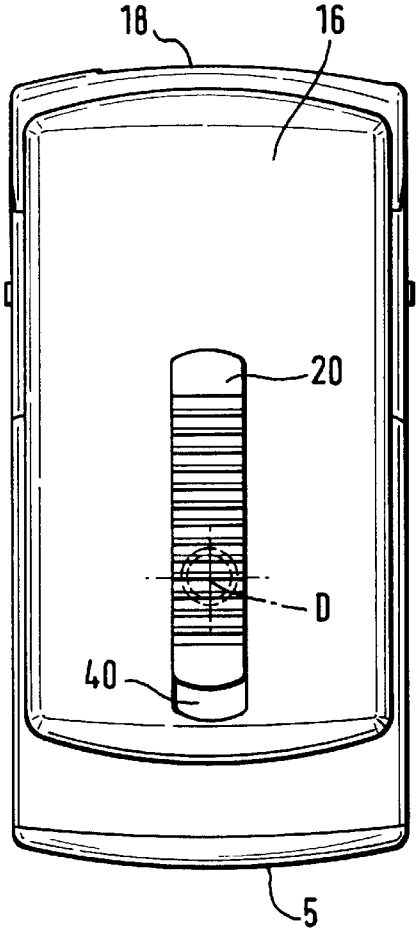
FIG. 11 is a front view of the dry shaving apparatus of FIG. 9, showing a shaver assembly protected by the cap portion and a control switch in the OFF position.
Figure 9:
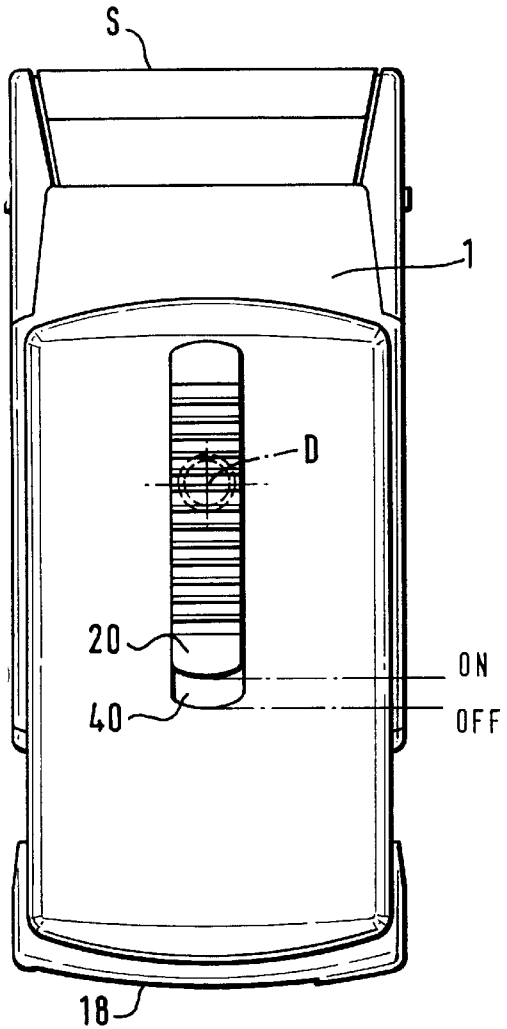
FIG. 9 is a front view of a dry shaving apparatus with a cap portion located opposite the shaver assembly and a control switch shown in the ON position.
Figure 13:
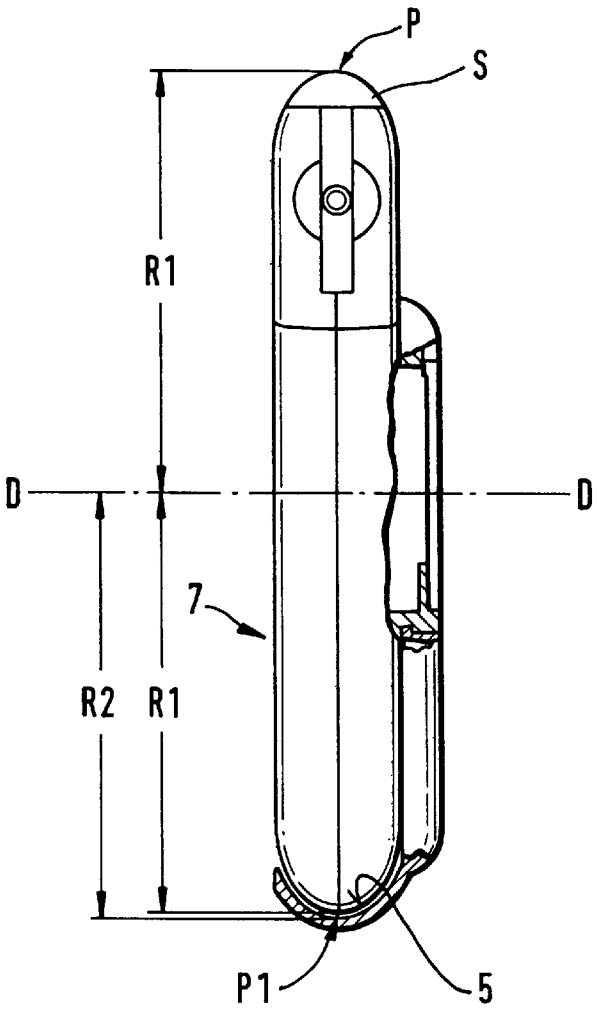
FIG. 13 is a side view of the dry shaving apparatus of FIG. 12.

In FIGS. 9 and 11, a dry shaving apparatus is shown which has a rotary joint—formed by positive-engagement elements 12, 13, 14, 15—concealed by the guard wall 16. The configuration of the rotary joint(s) corresponds substantially to the configuration of FIG. 4 and the related description. In contrast to the embodiment of FIG. 4 in which there is a round through opening, a round recess configured as positive-engagement element 12 is formed on the inside of the guard wall 16, so that the positive-engagement element 13 formed as a round pin on the face wall 1 is concealed by the pivotally mounted guard wall 16. In FIG. 9, the dry shaving apparatus is illustrated with a shaver assembly S released for use. Consequently, the cap portion 18 formed on the guard wall 16 for protection of the shaver assembly S is in a position parallel to the narrow sidewall 5 forming the bottom wall. A rotation through an angle of 180° about the axis of rotation D causes the guard wall 16 with its cap portion 18 to swing over the shaver assembly S and to occupy the position shown in FIG. 11. This swinging motion can be performed only after the control switch 20 shown in FIG. 9 is moved from the position ON shown into the position OFF. Details of the configuration of the control switch 20 are illustrated in FIG. 10 and will be described in greater detail in the following.

Figure 10:
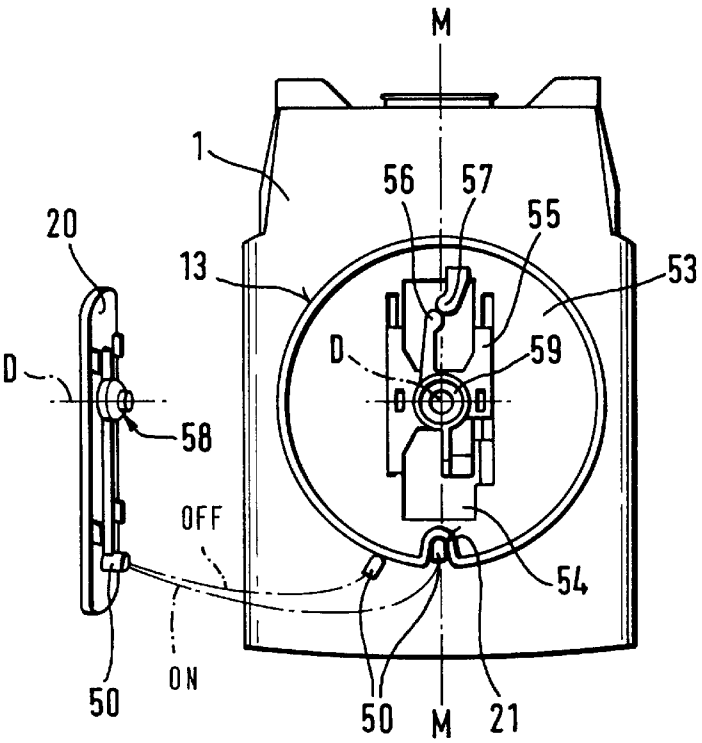
FIG. 10 is a view of a casing shell including a positive-engagement element, and a control switch with a detent means.

FIG. 10 shows a face wall 1 of the casing 7 with a positive-engagement element 13 which is adapted to be coupled to a further positive-engagement element 12 of the guard wall 16 and is rotatable about the axis of rotation D, as well as a control switch 20 with a pin 50 which in the course of the pivotal motion of the guard wall 16 and the control switch 20 about the axis of rotation D slides along the circular-ring-shaped annular wall of the positive-engagement element 13, entering the area of a recess formed in the annular wall and serving as contact path for the control switch 20. This recess is located on the vertical center line splitting the face wall 1 into two congruent halves. In a wall 53 a sliding member 55 is vertically slidably arranged in an elongated slot 54, with the position of the sliding member 55 being determinable by means of two cooperating positive-engagement elements 56, 57. The control switch 20 is adapted to be coupled with the sliding member 55 by means of plug-and-socket connectors 58, 59. With the control switch 20 in the OFF position and the shaver assembly S released by the cap portion 18, following coupling of the control switch 20 to the sliding member 55 the pin 50 is outside the annular wall of the positive-engagement element 13 and can be moved into the contact path 40 for the purpose of actuating the dry shaving apparatus, in which process the positive-engagement elements 56 and 57 are moved from the first positive-engagement position into a second positive-engagement position. In this condition, the control switch 20 and the guard wall 16 occupy the position illustrated in FIG. 9. To be able to execute the pivotal motion of the guard wall 16 and thus of the cap portion 18 into the position illustrated in FIG. 11, it is first necessary for the control switch 20 to be moved from the ON position into the OFF position. As this movement is taking place, the pin 50 slides out of the contact path 21, and with the rotation about the axis of rotation D continuing, then slides along the circular-ring-shaped annular wall of the positive-engagement element 13 until the shaver assembly S is covered by the cap portion 18. The pin 50 is then in a 180° offset orientation relative to the position of the contact path 21, in which position the circular-ring-shaped annular wall of the positive-engagement element 13 prevents the pin from being displaced into and in opposition to a vertical direction. As a result, the control switch 20 of FIG. 11 is locked in the OFF position shown, that is, it cannot be moved into the contact path 40.

We claim:

1. A dry shaving apparatus comprising:

a casing formed by face walls and narrow sidewalls, at least one driven cutter assembly, at least one control switch, a guard member comprising a cap portion of an essentially U-shaped configuration for protecting the cutter assembly and at least one guard wall extending parallel to the face walls, wherein the guard member is pivotally mounted on at least one of the face walls of the casing by means of a rotary joint, and wherein the control switch is actuatable only when the cap portion and the guard wall are in a pivot position in which the cutter assembly is released.

2. The dry shaving apparatus as claimed in claim 1, wherein the rotary joint is formed by cooperating positive-engagement elements provided on said one face wall and on the guard wall.

3. The dry shaving apparatus as claimed in claim 2, wherein the positive-engagement elements are configured as a round recess and a round pin engaging said round recess.

4. The dry shaving apparatus as claimed in claim 3, wherein the round pin is provided on said one face wall of the casing.

5. The dry shaving apparatus as claimed in claim 3, wherein the round pin is provided on the guard wall.

6. The dry shaving apparatus as claimed in claim 3, wherein the round recess is provided in the guard wall.

7. The dry shaving apparatus as claimed in claim 6, wherein the round recess is configured as an opening extending completely through the guard wall.

8. The dry shaving apparatus as claimed in claim 3, wherein the round recess is configured as an opening extending completely through said one face wall of the casing.

9. The dry shaving apparatus as claimed in claim 3, wherein the round recess is provided in said one face wall of the casing.

10. The dry shaving apparatus as claimed in claim 2, wherein the positive-engagement elements of said one face wall and of the guard wall are held in cooperable fashion by means of a snap fitting.

11. The dry shaving apparatus as claimed in claim 10, wherein the snap fitting comprises a circumferential groove and a spring of a resilient spring arm adapted to snap into said groove.

12. The dry shaving apparatus as claimed in claim 11, wherein the positive-engagement elements are configured as a round recess and a round pin engaging said round recess and wherein the groove is provided on the round pin, and the spring arm with the spring is resiliently formed with the wall of a round recess.

13. The dry shaving apparatus as claimed in claim 3, further comprising slide ribs disposed between the round pin and the round recess.

14. The dry shaving apparatus as claimed in claim 13, wherein the slide ribs are integrally formed on an outer wall of the round pin.

15. The dry shaving apparatus as claimed in claim 13, wherein the slide ribs are integrally formed on an inner wall of the round recess.

16. The dry shaving apparatus as claimed in claim 2, further comprising a plug-and-socket connection cooperatively securing the positive-engagement elements of said one face wall and the guard wall.

17. The dry shaving apparatus as claimed in claim 1, wherein the guard member is formed by two guard walls and the cap portion connecting said guard walls.

18. The dry shaving apparatus as claimed in claim 1, wherein the guard member is formed by the guard wall and the cap portion provided on said guard wall.

19. The dry shaving apparatus as claimed in claim 1, wherein the guard member is held in at least one pivot position by means of resiliently mounted detent means.

20. The dry shaving apparatus as claimed in claim 1, wherein the control switch is arranged in the guard wall.

21. The dry shaving apparatus as claimed in claim 20, wherein the control switch together with the guard wall is pivotally mounted by means of the rotary joint.

22. The dry shaving apparatus as claimed in claim 2, wherein one of the positive-engagement elements securing the control switch extends completely through the guard wall.

23. The dry shaving apparatus as claimed in claim 1, wherein the control switch is configured as a slide control.

24. The dry shaving apparatus as claimed in claim 1, wherein a recess serving as a contact path for at least one control movement of the control switch is provided in the guard wall.

25. The dry shaving apparatus as claimed in claim 24, wherein the recess of the contact path is provided in the pivotally mounted guard wall.

26. The dry shaving apparatus as claimed in claim 24, wherein the recess of the contact path is provided in said one face wall of the casing.

27. The dry shaving apparatus as claimed in claim 26, wherein the recess of the contact path is formed in an annular wall of the guard wall.

28. The dry shaving apparatus as claimed in claim 27, the control switch further comprising a pin movable into the contact path.

29. The dry shaving apparatus as claimed in claim 1, said rotary joint defining an axis of rotation wherein the axis of rotation is at an equal distance from the sidewalls.

30. The dry shaving apparatus as claimed in claim 29, wherein a relative distance of the axis of rotation to an outermost point of the cutter assembly is greater than a distance to an outermost point of the section of the casing opposite the cutter assembly.

31. The dry shaving apparatus as claimed in claim 29, wherein a relative distance of the axis of rotation to an outermost point of the cutter assembly is equal to a distance to an outermost point of the section of the casing opposite the cutter assembly.

* * * * *